US008353253B2

(12) United States Patent
Outland et al.

(10) Patent No.: US 8,353,253 B2
(45) Date of Patent: Jan. 15, 2013

(54) FASTENERS, COVER SYSTEMS, AND RELATED METHODS

(76) Inventors: Steven C. Outland, Jacksonville, NC (US); James G. Outland, Jacksonville, NC (US)

( * ) Notice: Subject to any disclaimer, the term of this patent is extended or adjusted under 35 U.S.C. 154(b) by 586 days.

(21) Appl. No.: 12/486,570

(22) Filed: Jun. 17, 2009

(65) Prior Publication Data

US 2009/0307879 A1 Dec. 17, 2009

Related U.S. Application Data

(60) Provisional application No. 61/073,347, filed on Jun. 17, 2008.

(51) Int. Cl.

| | |
|---|---|
| ***B63B 19/22*** | (2006.01) |
| ***B63B 19/12*** | (2006.01) |
| ***A44B 19/00*** | (2006.01) |
| ***A44B 99/00*** | (2010.01) |

(52) U.S. Cl. ..... 114/203; 114/201 R; 24/580.1; 24/590.1

(58) Field of Classification Search ..... 114/173–178, 114/201 R–201 A, 361, 343; 24/453, 580.1, 24/580.11, 589.1, 590.1, 593.1, 593.11, 598.1, 24/DIG. 51–DIG. 58

See application file for complete search history.

(56) References Cited

U.S. PATENT DOCUMENTS

| | | | | | |
|---|---|---|---|---|---|
| 1,209,783 | A | * | 12/1916 | Van Horn | 24/590.1 |
| 1,287,077 | A | * | 12/1918 | Neider | 24/580.1 |
| 1,335,363 | A | * | 3/1920 | Bourque | 24/581.1 |
| 1,412,097 | A | * | 4/1922 | Weimer | 24/581.11 |
| 1,504,486 | A | * | 8/1924 | Lane | 24/581.11 |
| 1,682,027 | A | * | 8/1928 | Zimmermann et al. | 135/133 |
| 4,527,760 | A | * | 7/1985 | Salacuse | 248/108 |
| 4,893,851 | A | * | 1/1990 | Murai | 292/204 |
| 5,195,445 | A | * | 3/1993 | Riddles et al. | 114/201 R |
| 5,471,715 | A | * | 12/1995 | Knize | 24/586.1 |
| 5,756,185 | A | * | 5/1998 | Lesser | 428/192 |
| 2008/0216735 | A1 | * | 9/2008 | Boyd | 114/361 |

* cited by examiner

*Primary Examiner* — Ajay Vasudeva
(74) *Attorney, Agent, or Firm* — Bennett Mullinax, LLC

(57) ABSTRACT

Fasteners, cover systems, and related methods are provided. A fastener for fastening an item in place on an object can include a bottom member having a first cross-sectional shape and a top member having a second cross-sectional shape that is securable to the bottom member. The top member can be rotatable relative to the bottom member once the top member is secured to the bottom member. The fastener can also include a securement device for fastening the bottom member to an object. The fasteners can be part of a cover system that also includes a cover. The cover system can be used in conjunction with a window, such as a boat hatch.

20 Claims, 12 Drawing Sheets

FASTENERS, COVER SYSTEMS, AND RELATED METHODS

RELATED APPLICATIONS

The presently disclosed subject matter claims the benefit of U.S. Provisional Patent Application Ser. No. 61/073,347 filed Jun. 17, 2008, the disclosure of which is incorporated herein by reference in its entirety.

TECHNICAL FIELD

The present subject matter generally relates to fasteners and covers that can be held in place by the fasteners. More particularly, the present subject matter relates to cover systems, fasteners and related methods that can be used to attach and maintain objects in a predetermined position, for example, such as to hold in position a cover on a boat hatch to impede unwanted radiant energy and light from entering the cabin of the boat in which the boat hatch resides.

BACKGROUND

Hatches, particularly hatches for boats, are fairly well known devices that allow ingress and egress into and out of enclosed areas, e.g., boat cabins, and/or allow light to enter an enclosed area. Deck hatches are available in many sizes, from small ventilation hatches to larger hatches used as emergency exit points. A ventilation hatch might be as small as 12 inches by 12 inches, where as a typical large hatch intended for persons and objects to pass through might be 20 inches by 20 inches. Hatches generally can comprise assemblies that allow entry, exiting and closure, and can comprise a window portion, a base, a hinge connecting the window portion and the base, and a gasket between the cover and the base to ensure a water-tight seal. Hatches may be installed on boat hulls and decks.

A typical boat can easily incorporate multiple boat hatches. For example, a typical boat hatch can have a dozen or more such boat hatches, with each hatch having a window portion. These boat hatches allow sunlight and its radiant energy to enter the cabin of the boat on which the hatches are used through the window portions of the hatches.

Sunny days are usually the days when a boat owner wants to use his or her boat. Over a short period of time on a sunny day, a large amount of heat can build up in the cabin. Due to the necessity to conserve space, most cabins in boats only have small air conditioning units, if they have any at all. Such air conditioning units can be overwhelmed by the build up of heat caused by sunlight passing through these boat hatches. Further, on days when the boat is not in use, the heat builds with no counter measures taken. This built-up heat and the radiation from the sunlight can cause damage to the interior of the cabin and the items therein. While tinting and UV protection treatment of the window portions of the boat hatches can cut down on the amount of light and energy entering the cabin, heat build-up can still be a problem.

Covers have been developed that are constructed of fabrics and draw strings. The fabric covers are placed over the boat hatches and drawn tight. While these fabric covers can prevent the ingress of sunlight into the cabin of a boat through the boat hatches, these covers are cumbersome to use. They are hard to install and remove from the boat hatches. Installation and removal of these fabric covers is time-consuming. Further, the fabric covers have a tendency to wear out. The fabrics are often made of synthetic yarns that have a tendency to break down over time in the harsh conditions of sunlight and water in which the fabrics are used.

The present subject matter provides fasteners, cover systems and related methods that can be used to hold covers or other items to an object, such as, for example, a cover system for covering a boat hatch.

SUMMARY

In accordance with this disclosure, fasteners for holding covers or other items in place on an object, cover systems and related methods are provided. It is, therefore, an object of the present disclosure to provide a fastener that can be attached to an object, such as a window, to hold a cover or other item thereto. It is another object of the present disclosure to provide a cover system for use on boat hatches or windows in other environments. This and other objects of the present disclosure as can become apparent from the present disclosure are achieved, at least in whole or in part, by the subject matter described herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Reference will now be made in detail to possible embodiments of the present subject matter, one or more examples of which are shown in the figures. Each example is provided to explain the subject matter and not as a limitation. In fact, features illustrated or described as part of one embodiment can be used in another embodiment to yield still a further embodiment. It is intended that the present subject matter cover such modifications and variations.

FIGS. 1A-1E illustrates a fastener, generally designated 10, according to the present subject matter for use to fasten an item to an object, such as a window. For example, the fastener 10 can be attached to a boat hatch as shown in FIGS. 8A-8E to hold a cover in place over an outer surface of the window portion of the boat hatch. In this manner with the fastener 10 and cover in place, the amount of sunlight that enters and thereby the amount of heat that builds up in a cabin of the boat on which the boat hatch resides can be reduced or eliminated.

The fastener 10 can include a first, or a bottom, member 12 and a second, or a top, member 14. The top member 14 can be rotatable relative to the bottom member 12. For example, the top member 14 can be rotatable in a clockwise and/or counterclockwise direction relative to the bottom member 12. The top member 14 can be a separate part from the bottom member 12. Thus, top member 14 can be secured to the bottom member 12 in such a manner that the top member 14 is rotatable relative to the bottom member 12 once the top member 14 is secured to the bottom member 12. Both the top member 14 and the bottom member 12 of fastener 10 can be constructed or formed from different types of material. For example, the top member 14 and the bottom member 12 can be created from a thermoplastic such a polypropylene, polyethylene, nylon, polyvinyl chloride, polyester, or the like. For instance, the top member 14 and the bottom member 12 can be formed of such a thermoplastic in a molding process. Thus, the fastener 10 can be made of a UV resistant material that retains its shape and does not become brittle when exposed to sunlight. The fastener 10 can be inconspicuous, smooth on its exterior. When used in conjunction with a boat hatch, the fastener 10 can conform to the normal hardware design of such hatches.

Figure 1A:
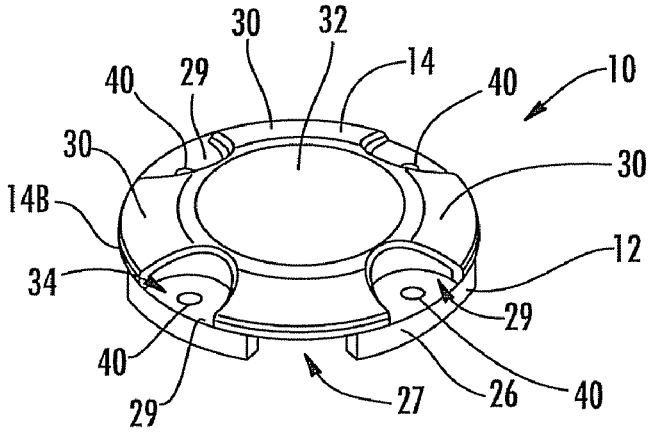
FIG. 1A illustrates a perspective view of an embodiment of a fastener with the fastener in a closed position according to the present subject matter.
Figure 1B:
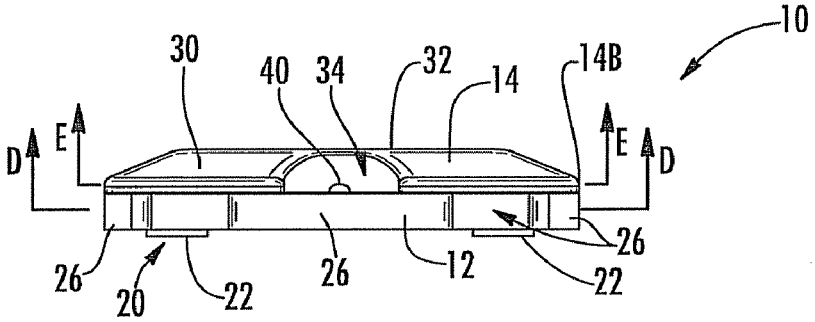
FIG. 1B illustrates a side view of the embodiment of the fastener shown in FIG. 1A with the fastener in a closed position.
Figure 1C:
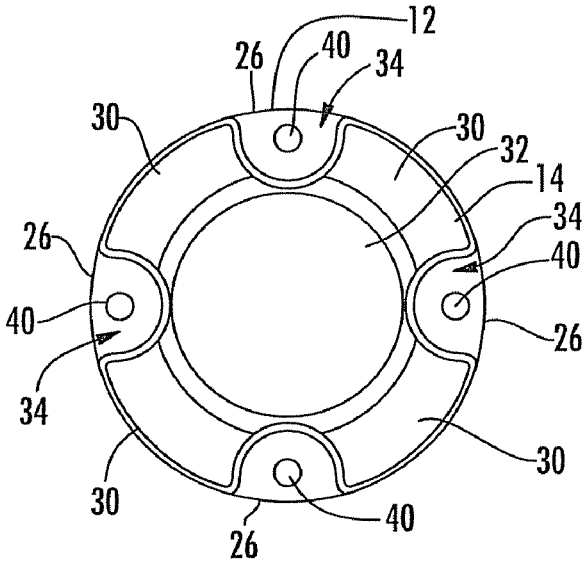
FIG. 1C illustrates a top plan view of the embodiment of the fastener shown in FIG. 1A with the fastener in a closed position.
Figure 1D:
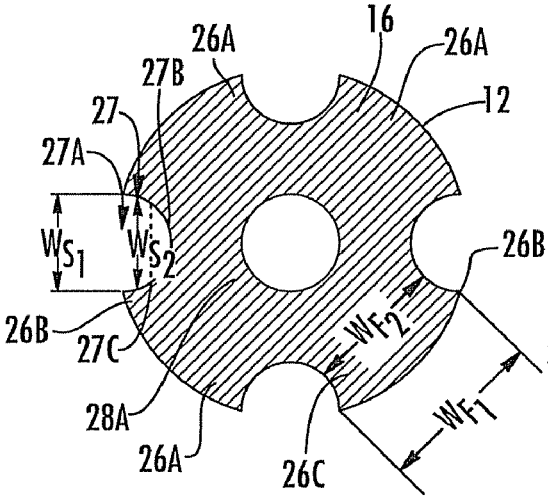
FIG. 1D illustrates a horizontal cross-sectional view of a bottom member of the embodiment of the fastener shown in FIG. 1B taken along the lines D-D.
Figure 1E:
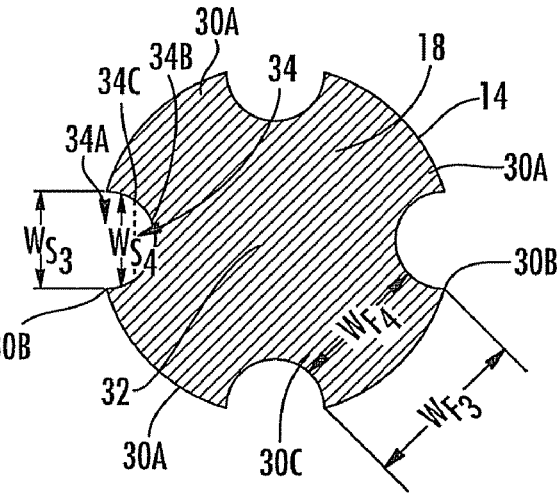
FIG. 1E illustrates a horizontal cross-sectional view of a top member of the embodiment of the fastener shown in FIG. 1B taken along the lines E-E.
Figure 2A:
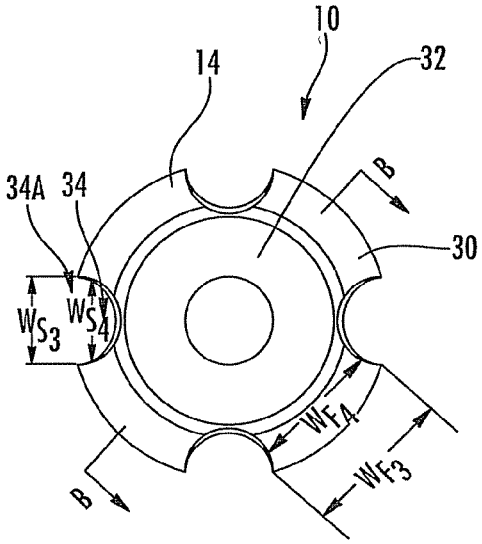
FIG. 2A illustrates a top plan view of the embodiment of the fastener shown in FIG. 1A with the fastener in an opened position.

The bottom member 12 and top member 14 can have shapes that are alignable with each other so that they permit an item, such as a cover, to be slipped over the fastener 10 such that the item is around at least a portion of the bottom member 12 when the top member 14 is in a first position, or open position (FIG. 2A). Upon rotation of the top member 14, the shape of the top member 14 can assume a second position, or closed position, as shown in FIGS. 1A-1C, that prevents the unintended removal of the item from around the bottom member 12. The shape of the bottom member 12 can be such that it prevents rotation of the item around the bottom member 12, while the item is secured thereon. To facilitate the securement of the item to the fastener 10, the bottom member 12 can have a first horizontal cross-sectional shape 16 as shown in FIG. 1D somewhere along its body around which an aperture in the item fits. Similarly, the top member 14 can also have a second cross-sectional shape 18 as shown in FIG. 1E that fits through the aperture in the item. The second cross-sectional 18 of the top member 14 can comprise the largest horizontal cross-sectional area of the top member 14 and can be located somewhere at one or more locations along the thickness $T_T$ (See FIG. 2B). For example, the second cross-sectional shape 18 of the top member 14 can be located at the base 14B of the top member 14 as shown in FIGS. 1A and 1B. In this manner, upon rotation of the top member to a closed position, the portion of the top member 14 that comprises the second cross-sectional shape 18 can abut against a portion of the item to better hold the item in place. The bottom member can have a thickness $T_B$ (See FIG. 2B). The thickness $T_B$ can be similar in dimensions to the thickness of the portion of the item where the aperture is defined therein that is used to place the item on the fastener 10. The thickness of the item in this area should be generally less than the thickness $T_B$ of the bottom member 12.

The second cross-sectional shape 18 of the top member 14 can correspondingly match the first cross-sectional shape 16 of the bottom member 12. In particular, the first cross-sectional shape 16 of the bottom member 12 and the second cross-sectional shape 18 of the top member 14 can be the same cross-sectional shape.

In operation, the second cross-sectional shape 18 of the top member 14 can be alignable with the first cross-sectional shape 16 of the bottom member 12 in a first position of the top member 14 relative to the bottom member 12 to permit placement of an item around at least a portion of the bottom member 12. For example, FIG. 2A shows such an alignment of the top member 14 and the bottom member 12 where the second cross-sectional shape 18 of the top member 14 is aligned with the first cross-sectional shape 16 of the bottom member 12. The portion of the bottom member 12 around which the item can be placed can be the first cross-sectional shape 16 (See FIG. 1D). The fastener 10 in FIG. 2A is thus shown in an open position that allows placement of an item around at least a portion of the bottom member 12.

Upon placement of an item around at least a portion of the bottom member 12, the top member 14 is then rotatable to a second position where the second cross-sectional shape 18 of the top member 14 is out of alignment with first cross-sectional shape 16 of the bottom member 12 as shown in FIGS. 1A-1C. In this second position of the top member 14, the top member 14 can hold the item in place around the bottom member preventing an unintended removal of the item from around the fastener 10. The fastener 10 can be considered to be in a closed position when the top member 14 is in such a second position.

The fastener 10 can also include a securement device, generally designated 20, for fastening the bottom member 12 to an object. The securement device 20 can be, for example, adhesive pads that can hold the fastener 10 on the object on which it is placed. The securement device 20 can be attached to an underside of the bottom member 12. For example, the securement device 20 in the form of adhesive pads 22 can be attached within at least one recess 24 in an underside of the bottom member 12 as shown in FIG. 3C. The adhesive can be strong enough to prevent an unintended removal of the fastener 10 from the object. At the same time, adhesive pads 20 can be selected to have a holding strength that will permit the release of the fastener 10 when a specified force is applied to the fastener that may cause damage to the object. In this manner, the fastener would release from the object before damage to the object may occur. For example, the adhesive pads can be constructed from double-sided adhesive foam tapes. For instance, the adhesive pads can be constructed from very high bond ("VHB") tape or pads. Such VHB tape or pads can be about 0.5 inch circular pads provided by 3M Corporation of Saint Paul, Minn. Other types of securement devices besides adhesive pads can be used.

While the fastener 10 and the other embodiments of fasteners shown in conjunction with a cover system can be used to hold other items to an object, the rest of the description of the fasteners will be done in conjunction with a cover.

As described above, the bottom member 12 and the top member 14 can have shapes that are alignable with each other so that they permit a cover to be slipped over the fastener 10 such that the cover is around at least a portion of the bottom member 12 when the fastener 10 is in an open position. Further, the shapes of the bottom member 12 and the top member 14 can hold a cover placed around the bottom member 12 in place when the shapes of the bottom member 12 and the top member 14 are out of alignment, when the fastener 10 is in a closed position.

Figure 3A:
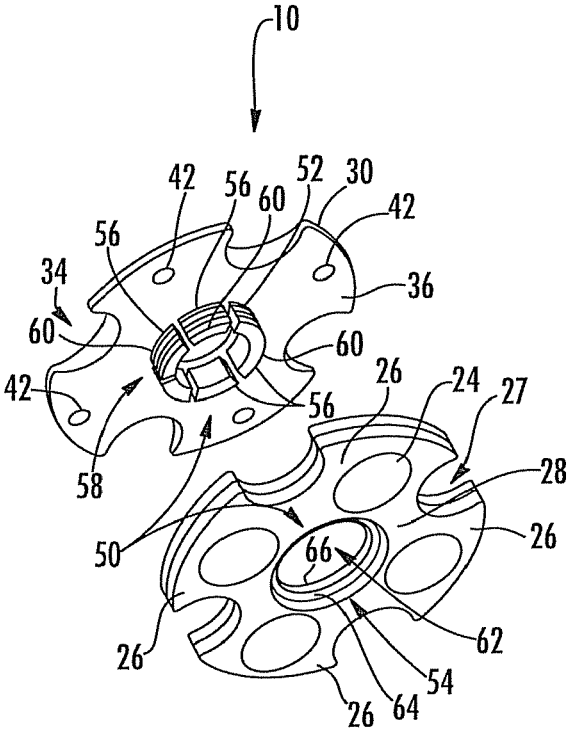
FIG. 3A illustrates an exploded view of an embodiment of a fastener from the underside of the fastener according to the present subject matter.
Figure 3B:
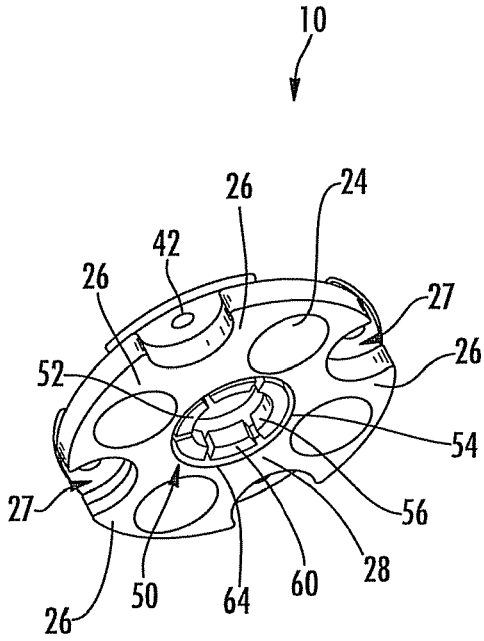
FIG. 3B illustrates a perspective view of the embodiment of the fastener from the underside of the fastener according to FIG. 3A.
Figure 3C:
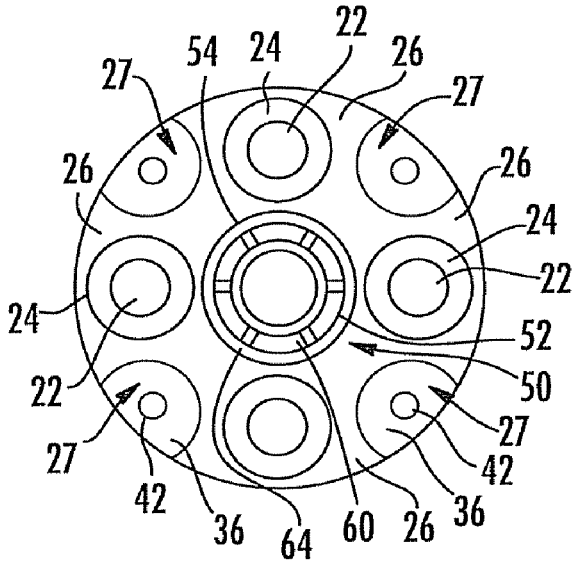
FIG. 3C illustrates a bottom plan view of the embodiment of the fastener from the underside of the fastener according to FIG. 3A.

For example, the shape of the bottom member 12 can include one or more flanges 26 extending outward from a central segment 28 of the bottom member 12 as shown in FIGS. 3A-3C. Similarly, the top member 14 can include one or more flanges 30 extending outward from a central segment 32 of the top member 14 as shown in FIGS. 1A-1C and 2A. Thereby, the first cross-sectional shape 16 of the bottom member 12 can include one or more flanges 26A extending outward from a central segment 28A. Similarly, the second cross-sectional shape 18 of the top member 14 can include one or more flanges 30A extending outward from a central segment 32A. The flanges 26, 30 of the bottom and top members 12, 14 can be aligned with each other so that they permit a cover to be slipped over the fastener 10. The flanges 26, 30 of the bottom and top members 12, 14 can then be placed out of alignment by rotation of the top member 14 relative to the bottom member 12 to hold a cover placed around the bottom member 12 in place so that the fastener 10 is in a closed position.

In the embodiment shown in FIGS. 1A-3C, the bottom member 12 can have four equally-spaced flanges 26. Thereby, the first cross-sectional shape 16 of the bottom member 12 can have four equally-spaced flanges 26A. These flanges 26 can form a cross configuration. Spaces, such as channels 27, can be defined between adjacent flanges 26. Each of the four flanges 26 of the bottom member 12 can have a width $W_{F1}$ that is wider at a distal outer end 26B of the flange 26 than a width $W_{F2}$ at an inner end 26C of the flange 26 that is proximal to the central segment 28 of the bottom member 12. Depending on these widths of the flanges 26, the channels 27 defined between adjacent flanges 26 can have an interior portion that has a width $W_{S2}$ that is the same as a width $W_{S1}$, of an inlet portion 27A located proximal to the distal outer ends 26B of the flanges 26. Thereby, in such an embodiment, each channel 27 can have the same width from the interior portion that starts at the end 27C (indicated by a dotted line) of a rounded base portion 27B of the channel 27 and extends through the inlet portion. In some embodiments, the channels may have no rounded base portion. Alternatively, the channels 27 defined between adjacent flanges 26 can have an interior portion that has the width $W_{S2}$ in at least one section of the channel 27 that is wider than the width $W_{S1}$, of an inlet portion 27A located proximal to the distal outer ends 26B of the flanges 26. An example of such an alternative embodiment is shown in FIGS. 6A and 6B.

Similarly, the top member 14 can have four equally-spaced flanges 30. Thereby, the second cross-sectional shape 18 of the top member 14 can have four equally-spaced flanges 30A. These flanges 30 can also form a cross configuration. Spaces, such as channels 34, can be defined between adjacent flanges 30. Each of the four flanges 30 of the top member 14 can have a width $W_{F3}$ that is wider at a distal outer end 30B of the flange 30 than a width $W_{F4}$ at an inner end 30C of the flange 30 that is proximal to the central segment 32 of the top member 14. Depending on these widths of the flanges 30, the channels 34 defined between adjacent flanges 30 can have an interior portion that has a width $W_{S4}$ that is the same as a width $W_{S3}$ of an inlet portion 34A located proximal to the distal outer ends 30B of the flanges 26. Thereby, in such an embodiment, the channel can have the same width from the interior portion that starts at the end 34C (indicated by a dotted line) of a rounded base portion 34B of the channel 34 and extends through the inlet portion. In some embodiments, the channels may have no rounded base portion. Alternatively, the channels 34 defined between adjacent flanges 30 can have an interior portion that has the width $W_{S4}$ in at least one section of the channel 34 that is wider than the width $W_{S3}$ of an inlet portion 34A located proximal to the distal outer ends 30B of the flanges 30. An example of such an alternative embodiment is shown in FIGS. 6A and 6B.

The widths $W_{F1}$ and $W_{F2}$ of the flanges 26 can be greater than the widths of the channel 34. Also, the widths $W_{F3}$ and $W_{F4}$ of the flanges 30 can be greater than the widths of the channel 27. In this manner, when the top member 14 is in the second position with the fastener 10 in the closed position, the flanges 30 of the top member 14 can overlap the flanges 26 of the bottom member 12. Further, the channels 34 can be completely covered by the flanges 26 and the channels 27 can be completely covered by the flanges 30. The overlaps of the flanges 30 of the top member 14 and the flanges 26 of the bottom member 12 can create a stability along the fastener 10 from the central segments to the outer perimeter across the fastener 10.

The top member 14 can have an outer perimeter that is at least partially circumferential. Further, the bottom member 12 can have an outer perimeter that is at least partially circumferential. In such embodiments, when the top member 14 is in the second position with the fastener 10 in a closed position, the fastener 10 can have a full circumferential outer perimeter created by overlap of the top member 14 and the bottom member 12.

To help hold the fastener 10 in either the open position or the closed position, the bottom member 12 can include one or more protuberances 40 on its top surface 29. Also, the top member 14 can have one or more matching recesses 42 defined on its under surface 36. When the top member 14 is in the first position, i.e., the fastener is in an open position, each of the one or more protuberances 40 can reside in a corresponding recess 42 of the one or more matching recesses 42. In such a position, the protuberances 40 help hold the fastener in an open position by providing a resistance to movement of the top member 14 back to its first position by contact of each protuberance 40 against an outer wall of a corresponding recess 42 upon rotation of the top member 14 that has to be overcome by a specific amount of force.

In this embodiment, each of the one or more protuberances 40 can reside in the space, i.e. channel 34, between adjacent flanges 20 of the top member 14 when the top member 14 is in the second position and the fastener 10 is in the closed position as shown in FIGS. 1A-1C. In such a position, the protuberances 40 help hold the fastener in a closed position by providing a resistance to movement of the top member 14 back to its first position by contact of each protuberance 40 against an outer wall of a flange 30 upon rotation of the top member 14 that has to be overcome by a specific amount of force.

Figure 4:
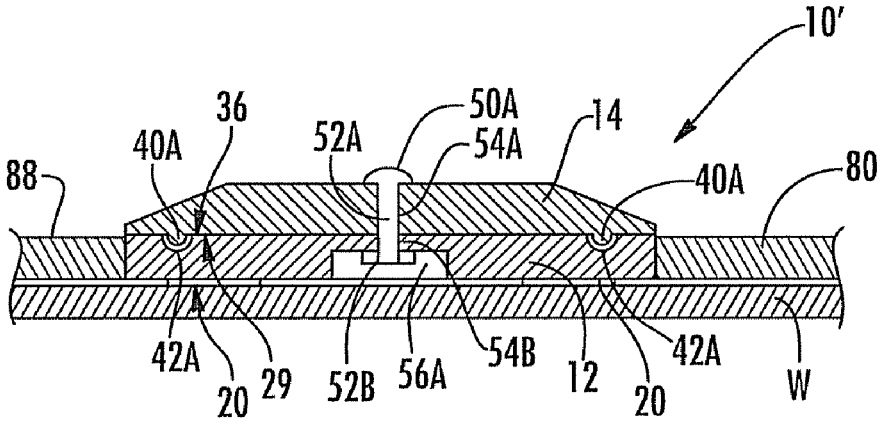
FIG. 4 illustrates a cross-sectional side view of an embodiment of a cover system according to the present subject matter.

Alternatively, as shown in the embodiment in FIG. 4, the top member 14 can include one or more protuberances 40A on its underside, i.e. under surface 36, while the bottom member 12 can have one or more matching recesses 42A defined on its top surface 29. When the top member 14 is in the first position, i.e., the fastener is in an open position, each of the one or more protuberances 40A can reside in a corresponding recess 42A of the one or more matching recesses 42A. In such a position, the protuberances 40A help hold the fastener in an open position by providing a resistance to movement of the top member 14 back to its first position by contact of each protuberance 40 against an outer wall of a corresponding recess 42A upon rotation of the top member 14 that has to be overcome by a specific amount of force.

In this embodiment, each of the one or more protuberances 40A can reside in the space, i.e. channel, between adjacent flanges of the bottom member 12 when the top member 14 is in the second position and the fastener 10 is in the closed position. In such a position, the protuberances 40A help hold the fastener in a closed position by providing a resistance to movement of the top member 14 back to its first position by contact of each protuberance 40 against an outer wall of a flange of the bottom member 12 upon rotation of the top member 14 that has to be overcome by a specific amount of force.

The fastener 10 can also include an attachment member that is used to secure the top member 14 and the bottom member 12 to one another. The attachment member can be at least one of a rod, rivet, screw, or bolt and nut configuration. Alternatively, the attachment member comprises a male and female connection.

For example, as shown in FIGS. 3A-3C, the fastener 10 can include an attachment member 50 that includes a male portion 52 that extends outward from an under surface 36 of the top member 14. The attachment member 50 also includes a female portion 54. In particular, the male portion 52 comprises two or more sections 56 of a generally cylindrical body 58. The sections 56 can have space provided between them. Each section 56 of the cylindrical body can have a lip 60 extending outwardly from the section 56 at an end distal from an under surface 36 of the top member 14. The female portion 54 of the attachment member 50 can include an aperture 62 defined in the bottom member 12 with the aperture 62 including at least one recess 64.

The sections 56 of the cylindrical body 58 of the male portion 52 can be proportioned such that the lips 60 are larger than the diameter of the upper outer rim 66 of the female portion 54. The space between the sections 56 of the cylindrical body 58 allow for deformation of the sections 56 inwardly. This deformation permits the lips 60 of sections 56 to enter into the aperture 62 passing the upper rim 66 of the aperture 54 and moving into the recess 64. Thereby, the lips 60 of the sections 56 reside in the recess 64 upon insertion of the sections 56 of the cylindrical body 58 of the male portion 52 into the aperture 62 of the female portion 54. Such an attachment member can secure the top member 12 and the bottom member 14 tightly together, while still permitting rotation of the top member in either a clockwise or counterclockwise direction.

Figure 5:
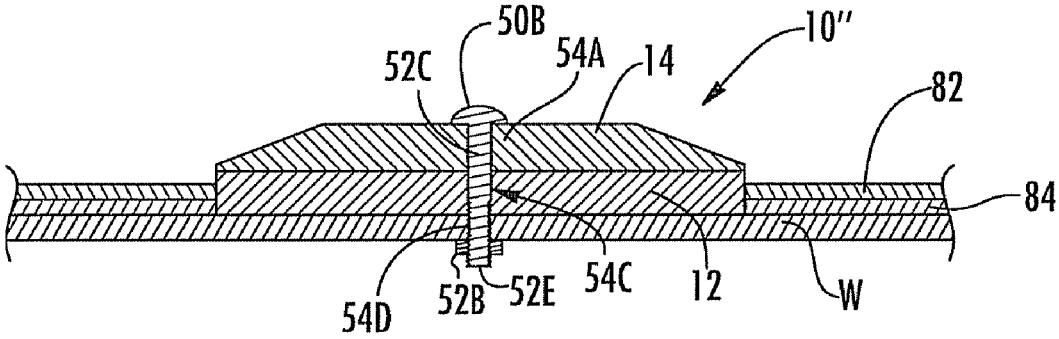
FIG. 5 illustrates a cross-sectional side view of another embodiment of a cover system according to the present subject matter.

FIGS. 4 and 5 illustrate vertical cross-sectional views of other embodiments of fasteners that can be used. For example, in FIG. 4, a fastener 10' is provided that includes a top member 14 and a bottom member 12. The top member 14 is secured to the bottom member 12 by an attachment member 50A. The attachment member 50A can be a nut and bolt arrangement that includes a shaft 52A that is at least partially threaded and a nut 52B which can be screwed onto the shaft 52A. The top member 14 can have a centrally located passageway 54A that passes therethrough. The passageway 54A can be alignable with an aperture 54B in the bottom member 12 that opens up to a recessed area 56A. The recess 56A can be wide enough to permit the securement of the nut 52B onto the shaft 52A of the attachment member 50A. The shaft 52A can be unthreaded on the portion that resides in the passageway 54A.

As described above, the top member 14 can include one or more protuberances 40A on its underside, i.e. under surface 36, while the bottom member 12 can have one or more matching recesses 42A defined on its top surface 29 to facilitate the holding on the fastener in an open position and, in some embodiments, a closed position. Further, the fastener 10' can be attached to a window W of, for example, a boat hatch by securement devices 20 in the form of adhesive pads as described above.

Figure 2B:
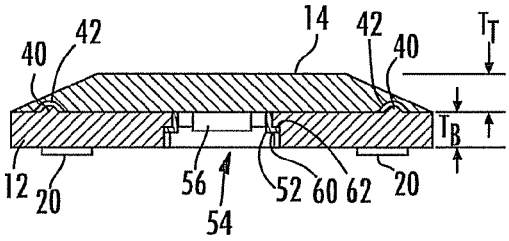
FIG. 2B illustrates a vertical cross-sectional view of the embodiment of the fastener shown in FIG. 2A taken along the lines B-B.

A cover 80 can be placed in a position above the window W and around the fastener 10' when the fastener 10' is in an open position. The cover 80 can have an aperture that permits the cover 80 to be slipped over the top member 14 and around the bottom member 12 when a second cross-sectional shape of the top member 14 is aligned with a first cross-sectional shape of the bottom member 12 when the top member 14 is in a first position. This first position of the top member 14 has the protuberances 40A residing in the recesses 42A and corresponds to an open position of the fastener 10'. The top member 14 can then be rotated to a second position where the second cross-sectional shape of the top member 14 is out of alignment with first cross-sectional shape of the bottom member 12 and the protuberances 40A are moved from recesses 42A such that the fastener 10' is in a closed position. In this closed position, the top member 14 holds the cover 80 over the window W and around the bottom member 12. The cross-sectional shape of the bottom member 12 around which the cover resides can be such that it prevents rotation of the cover around the fastener. The thickness of the cover can be close in dimensions to the thickness $T_B$ (See FIG. 2B showing a similar embodiment) of the bottom member 12 to prevent unnecessary move of the cover. In the above described manner, the cover 80 is held in place over the window W to protect and shield the window W and prevent sunlight and heat from passing through the window W.

In FIG. 5, a fastener 10" is provided that includes a top member 14 and a bottom member 12. The top member 14 is secured to the bottom member 12 by an attachment member 50B. The attachment member 50B can also include a nut and bolt arrangement that includes a shaft 52C that is at least partially threaded and a nut 52B which can be screwed onto an end of the shaft 52C that has passed through the top member 14, bottom member 12 and window W. The top member 14 can have a centrally located passageway 54A that passes therethrough. The shaft 52C can be unthreaded on the portion that resides in the passageway 54A. The passageway 54A can be alignable with an aperture 54C in the bottom member 12 and an aperture 54D in window W. The aperture 54C can be at least partially threaded. Once the shaft 52C of the bolt is placed through the passageway 54A and screwed into the bottom member 12 such an end 52E passes through the bottom member 12, the end 52E can be placed through the aperture 54C in the window W and the nut 52B can be screwed onto the shaft 52C of the attachment member 50B. In this manner, the attachment member 50B can also serve as the securement device for securing the fastener 10" to the window W. Seals can be included around the shaft 52C between the bottom member 12 and the window W and/or between the nut and the window W to prevent leakage around the aperture 54C in the window W.

In the embodiment shown in FIG. 5, two covers 82, 84 are provided that can be placed in a position above the window W and around the fastener 10' when the fastener 10' is in an open position. The thickness of each cover can be much less than the thickness $T_B$ (See FIG. 2B showing a similar embodiment) of the bottom member 12. In this manner, two complimentary covers that serve different functions can be held in place over the window W by the fastener 10". For example, the top cover 82 may be opaque to block radiant energy and light, while the bottom cover 84 can be translucent or semi-transparent to block at least some of the heat and light, while permitting some light to pass through. Thus, if the window is part of a boat hatch, the amount of light and radiant energy that enters the cabin can be more easily controlled or adjusted by the use of some, all, or none of the covers.

Figure 6C:
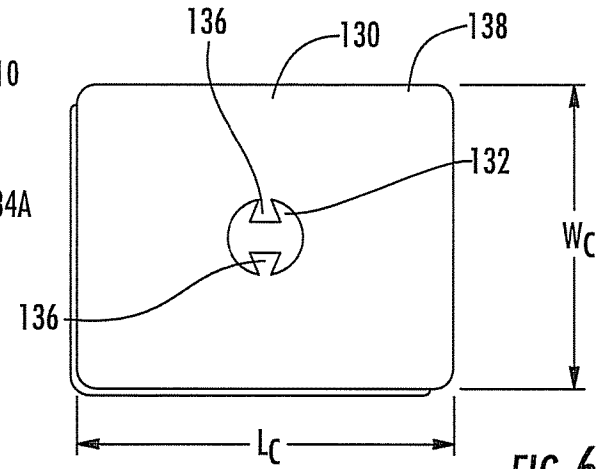
FIGS. 6A-6C illustrate an additional embodiment of a cover system according to the present subject matter.
Figure 6B:
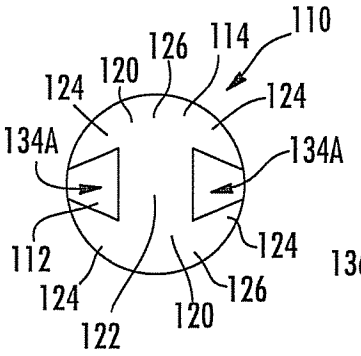
Figure 6A:
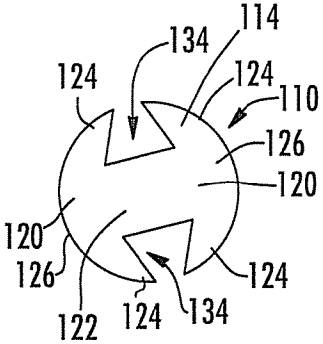

FIGS. 6A-6C and FIGS. 7A-7C show other embodiments of fasteners along with an associated cover that can be used. In FIGS. 6A-6C, a cover 130 and a fastener 110 that includes a top member 114 and a bottom member 112 and a cover 130 are provided. The top member 114 and the bottom member 112 can have an identical horizontal cross-sectional shape. Both the top member 114 and the bottom member 112 can have two flanges 120 that extend outwardly from a central segment 122. Each flange 120 can have a wing 124 extending outwardly from either side at an end 126 distal from the central segment 122. The wings 124 can facilitate the formation of channels 134 which is the space defined between the flanges 120 as defined at least partially by the wings 124. FIG. 6A shows the top member 114 in a first position relative to the bottom member 112 such that the cross-sectional shape of the top member 114 is in alignment with the cross-sectional shapes of the bottom member 112. When the top member 114 is in such a position it can be considered that the fastener 110 is in an open position.

The cover 130 can have a body 138 that is constructed or formed to have a width $W_C$ and length $L_C$ that approximates the width and length of the object to be covered. For example, the cover 130 can be the width and length of a window of a boat hatch. It is understood that the cover 130 can be formed or constructed to be any dimensions such that it can be other shapes other than a rectangle. The body 138 of the cover 130 can have an aperture 134 therein. In the embodiment shown in FIG. 6C, the aperture 132 is centrally located. Extensions 136 of the body 138 reside in the aperture 132. The extensions 136 correspond in size and shape to the channels 134.

Once the location for placement of the fastener 110 on an object is determined, the fastener can be attached to the object. The fastener 110 can be placed in an open position as shown in FIG. 6A. The cover 130 can then be placed over the top member 114 and around the bottom member 112 of the fastener 110 so that the extensions 136 reside in the channels 134 within the bottom member 112. The top member 114 can then be rotated to a second position such that the distal ends 126 of the flanges 120 of the top member 114 reside over the channels 134 in the bottom member 112, while the channels 134A of the top member 114 reside over the flanges 120 of the bottom member 112. When the top member 114 is in this position, the fastener 110 is in a closed position and the cover 130 is held over the intended object.

Figure 7B:
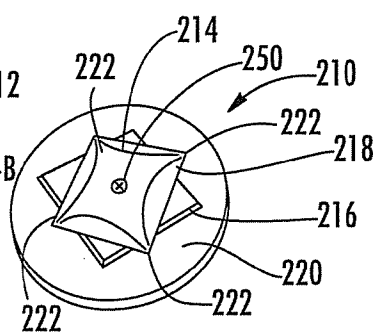
FIGS. 7A-7C illustrate a further embodiment of a cover system according to the present subject matter.
Figure 7A:
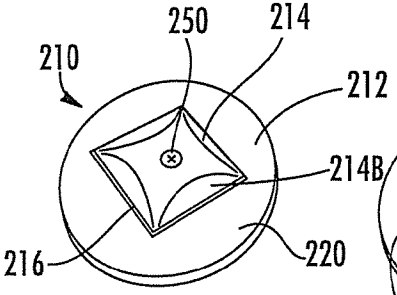
Figure 7C:
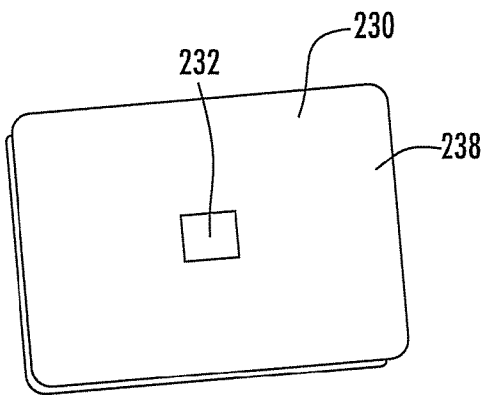

In FIGS. 7A-7C, a cover 230 and a fastener 210 that includes a top member 214 and a bottom member 212 are provided. The bottom member 212 can have a first cross-sectional shape 216. The first cross-sectional shape 216 of the bottom member 212 can be a rectangular cross-sectional shape. For example, the first cross-sectional shape 216 can have a square cross-sectional shape. The bottom member 212 can include a spacer section 220 under the first cross-sectional shape 216 of the bottom member 212.

The cover 230 can include a rigid or semi-rigid body 238. The body 238 of the cover 230 can have an aperture 232 therein having an outer perimeter shape that accepts the first cross-sectional shape 216 of the bottom member 212. For example, the aperture 232 of the cover 230 can have a rectangular shape that at least approximately matches the first cross-sectional shape 216 of the bottom member 212. Once the cover 230 is placed over the top member 214 and around the first cross-sectional shape 216 of the bottom member 214, the cover can reside on the spacer section 220. The spacer section 220 can create space between the cover 230 and the object on which the fastener 210 is placed.

The top member 214 can have a partially rounded shape with a second cross-sectional shape 218 at a base portion 214B of the top member 214 that is proximal to the bottom member 212. The second cross-sectional shape 218 of the top member 214 can be similar is size and shape to the first cross-sectional shape 216 of the bottom member 212. For example, the second cross-sectional shape 218 of the top member 214 can be a rectangular cross-sectional shape. For instance, the second cross-sectional shape 218 of the top member 214 can be a square cross-sectional shape. The top member 214 and the bottom member 212 can be held together by an attachment member 250. The attachment member 250 can be a rod, rivet, screw, bolt and nut arrangement or the like.

Once the location for placement of the fastener 210 on an object, such as a window, is determined, the fastener 210 can be attached to the object. The fastener 210 can be placed in an open position as shown in FIG. 6A. In particular, the rectangular shape of the second cross-sectional shape 218 of the top member 214 can be aligned with the rectangular shape of the first cross-sectional shape 216 of the bottom member 212. The cover 230 can then be placed over the top member 214 and around the bottom member 212 of the fastener 210 so that the perimeter walls of the aperture 232 are close to or abut the sides of the bottom member 212 along the first cross-sectional shape 216. The top member 214 can then be rotated to a second position such that the corners 222 at the base 214B that form part of the second cross-sectional shape 218 of the top member 214 reside over the body of the cover 230. When the top member 214 is in this position, the fastener 210 is in a closed position and the cover 230 is held over the intended object.

As stated above, the covers 80, 130, 230 can be any shape desired based on the shape of the object to be covered and the intended functionality of the covers. The covers 80, 130, 230 can be made in a variety of sizes, different colors, different materials, different opaqueness and different thicknesses. Each cover 80, 130, 230 can have a rigid or semi-rigid body 88, 138, 238, respectively. The bodies 88, 138, 238 of the covers 80, 130, 230 can be configured to accomplish different functions. For example, bodies 88, 138, 238 of the covers 80, 130, 230 can be configured to shield an outer surface of a window. The bodies 88, 138, 238 of the covers 80, 130, 230 also can define at least one aperture therein for receipt of a first cross-sectional shape of a bottom member of a fastener. Each body 88, 138, 238 of the respective covers 80, 130, 230 can have an outer perimeter that has dimensions that are about the same as dimensions of the object intended to be covered. For example, the outer perimeters of the bodies 88, 138, 238 of the covers 80, 130, 230 can have dimensions that are about the same as dimensions of a window portion of a boat hatch.

The bodies 88, 138, 238 of the covers 80, 130, 230 can be made out of different material. For example, the bodies 88, 138, 238 of the covers 80, 130, 230 can be formed or constructed from wood, metal, thermoplastic material or the like. For instance, the cover can be made out of polypropylene, polyethylene, nylon, polyvinyl chloride, polyester, or the like. However, in preferred embodiments, the covers 80, 130, 230 can be UV resistant, buoyant, and flexible. In some embodiments, the bodies 88, 138, 238 of the covers 80, 130, 230 can be semi-rigid and have flexibility. Thereby, if the covers 80, 130, 230 are caught on, for example, a rope, the rope may bend the covers 80, 130, 230 until, the rope becomes untangled without damaging the window to which the cover is held. Further, the bodies 88, 138, 238 of the covers 80, 130, 230 can have a density that permits it to be buoyant in water. For example, the density of the covers 80, 130, 230 can permit it to float on water. The density is determined by the material used to create the covers 80, 130, 230 and can be effect by the design of the covers 80, 130, 230.

Figure 9:
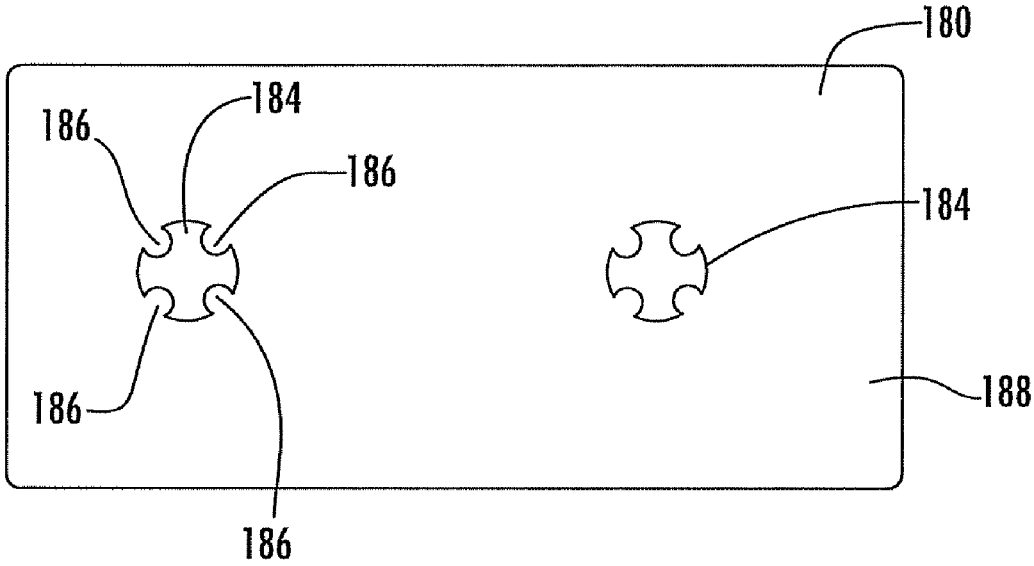
FIG. 9 illustrates a schematic top plan view of an embodiment of a cover according to the present subject matter.

FIG. 9 illustrates another embodiment of a cover 180. The cover 180 can have a body 188 that includes two apertures 184 that permit the use of two fasteners simultaneously to further stabilize the cover 180 over the object intended to be shielded. For example, the apertures 184 can be designed to be used with the fasteners 10 illustrated in FIGS. 1A-3C. Each aperture 184 can have four extensions 186 that fit inside the channels 26 and 34 of the bottom and top members 12 and 14 of a fastener 10.

A cover system for covering a boat hatch that uses the fasteners as described in detail above with reference to FIGS. 1A-3C will now be described. FIGS. 8A-8E, illustrate a boat hatch, generally 90, that can be used on a deck of a large marine vessel. The boat hatch 90 can include a window portion 92 that has a latch 93 attached to both a base 94 of the boat hatch 90 and the window portion 92. The latch 93 can be used to open the window portion 92 of the boat hatch 90. The base 94 provides a seal that prevents leakage of the boat hatch 90 once installed on a boat.

Figure 8A:
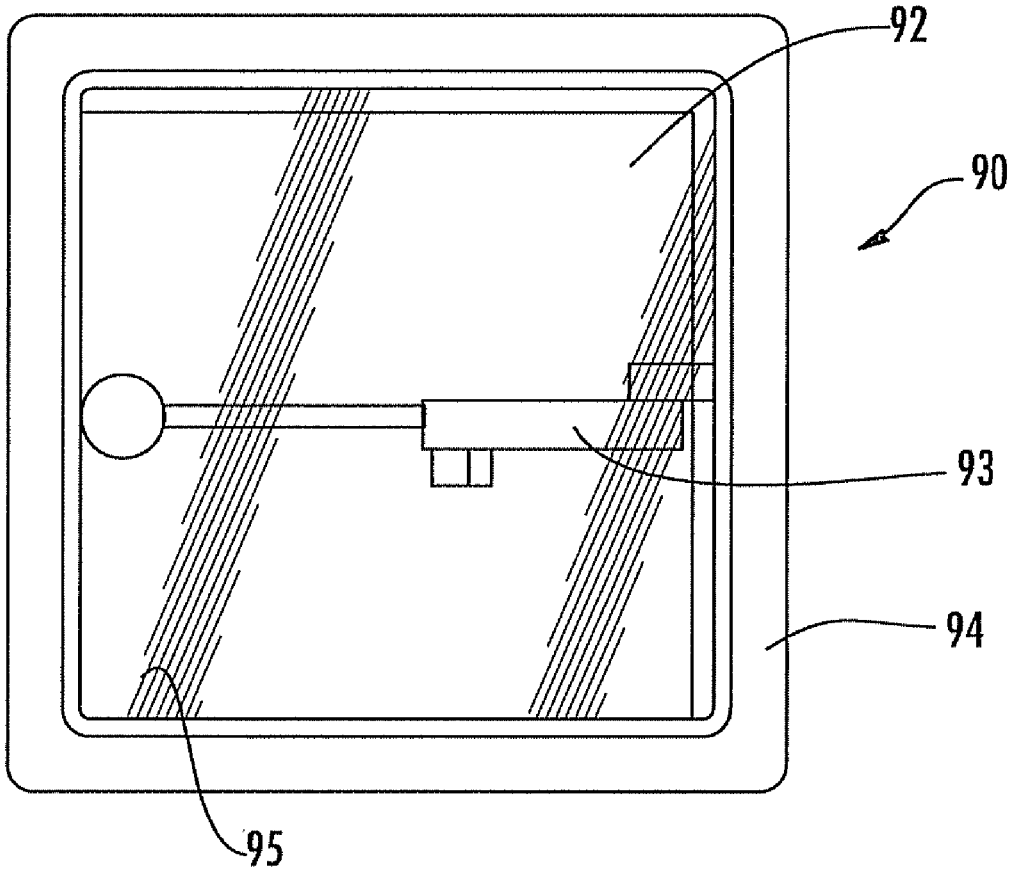
FIGS. 8A-8E illustrate steps of using of a cover system for attachment to a boat hatch according to the present subject matter.
Figure 8B:
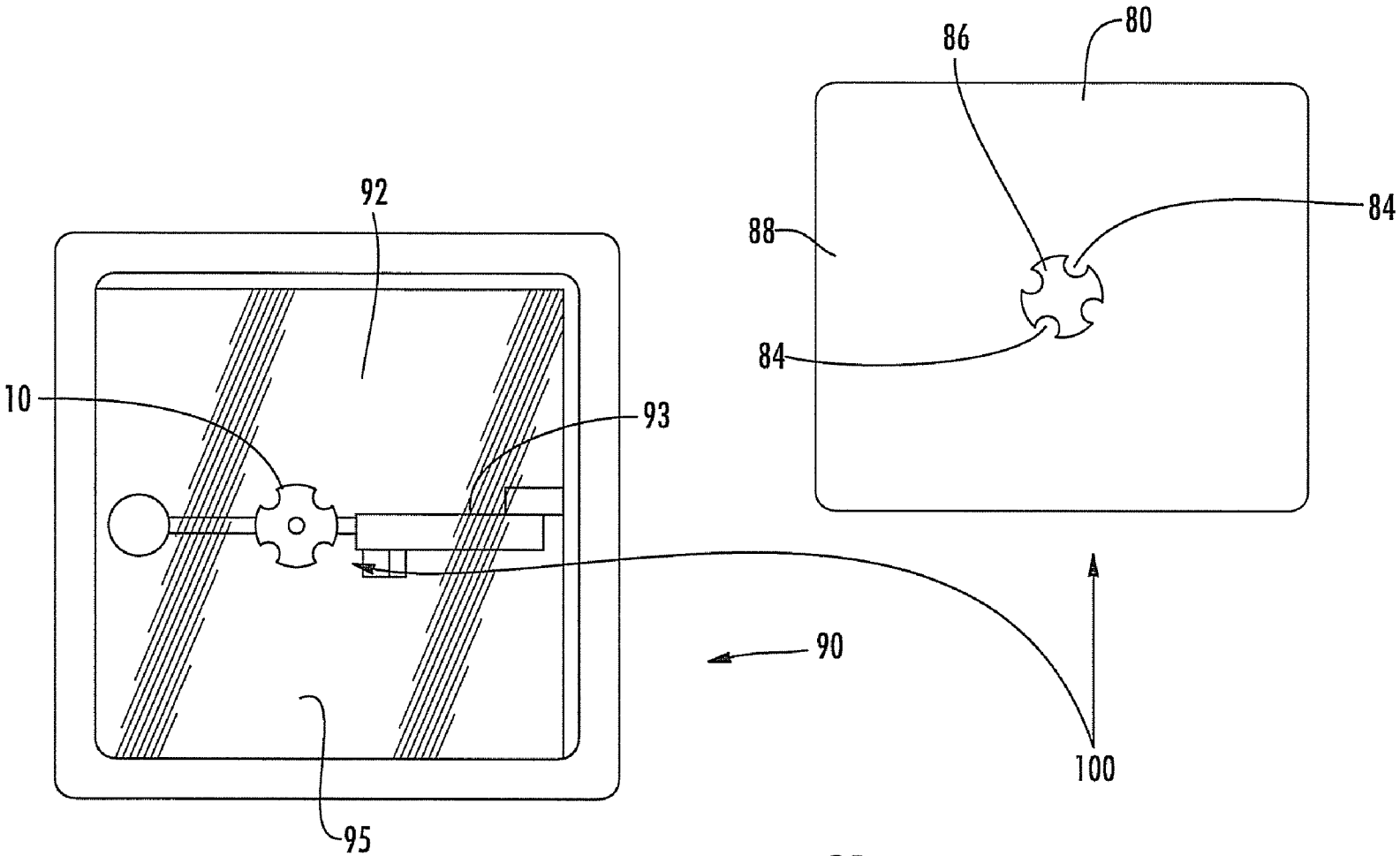

As shown in FIG. 8B a cover system 100 can be provided that includes at least one fastener 10 as described in detail above. As shown in FIGS. 1A-3C, the fastener 10 can include a bottom member 12 having a first cross-sectional shape 16 and a top member 14 that is securable to the bottom member 12. The top member 14 can be rotatable relative to the bottom member 12 once the top member 14 is secured to the bottom member 12. The top member 14 can have a second cross-sectional shape 18. The fastener 10 can also include a securement device 20 for fastening the bottom member 12 to an outer surface 95 of the window portion 92 of the boat hatch 90. The cover system 100 can also include a cover having a rigid body 88. The body 88 of the cover 80 can be configured to shield the window portion 92 of the boat hatch 90. The body 88 of the cover 80 can define at least one aperture 86 therein for receipt of the first cross-sectional shape 16 of the bottom member 12 of the fastener 10. For example, the body 88 can have extensions 84 that fit through channels 34 of the top member 14 and into the channels 27 of the bottom member 12.

As described above, the second cross-sectional shape 18 of the top member 14 of the fastener 10 can be aligned with the first cross-sectional shape 16 of the bottom member 12 of the fastener 10 in a first position of the top member 14 relative to the bottom member 12 as shown in FIG. 2A. This alignment permits placement of the cover 80 around at least a portion of the bottom member 12. The top member 14 can then be rotated to a second position where the second cross-sectional shape 18 of the top member 14 is out of alignment with first cross-sectional shape 16 of the bottom member 12 such that the top member 14 holds the cover 80 around the bottom member 12 as shown in FIGS. 1A-1C.

As shown in FIG. 8B, a position on the outer surface 95 of the window portion 92 of the boat hatch 90 can be located for attachment of the fastener 10 to the outer surface 95 through the securement device 20 (See FIG. 3C). The position on the outer surface 95 of the window portion 92 where the fastener 10 can be located can be about the center of the outer surface 95 as measured from the outer perimeter of a window portion 92 of the boat hatch 90. However, the placement of the fastener 10 depends on the placement of the aperture 86 in the body 88 of the cover 80. The fastener 10 is secured at the located position on the outer surface 95 of the boat hatch 90. The top member 14 can be in a first position or can be rotated to this first position so that the second cross-sectional shape 18 of the top member 14 of the fastener 10 is aligned with the first cross-sectional shape 16 of the bottom member 14 of the fastener 10 (see FIGS. 2A and 8A) to permit placement of the cover 80 around at least a portion of the bottom member 12.

Figure 8C:
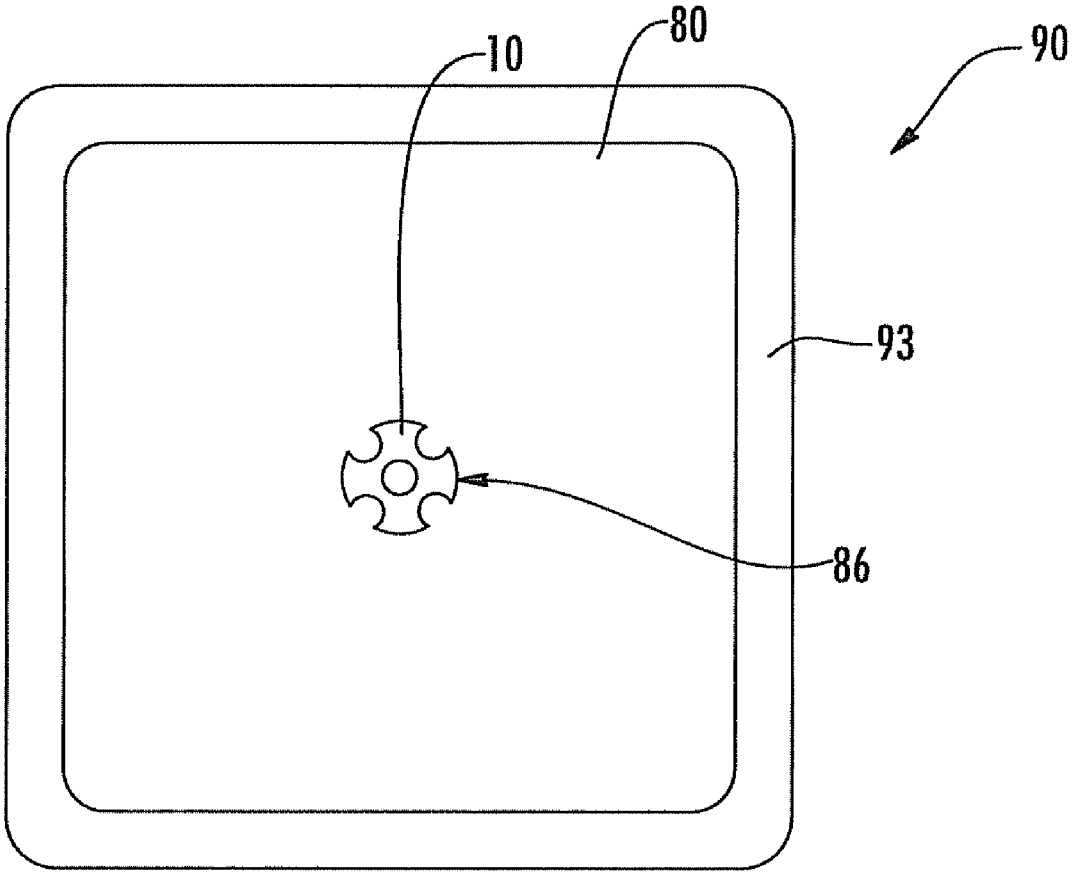
Figure 8D:
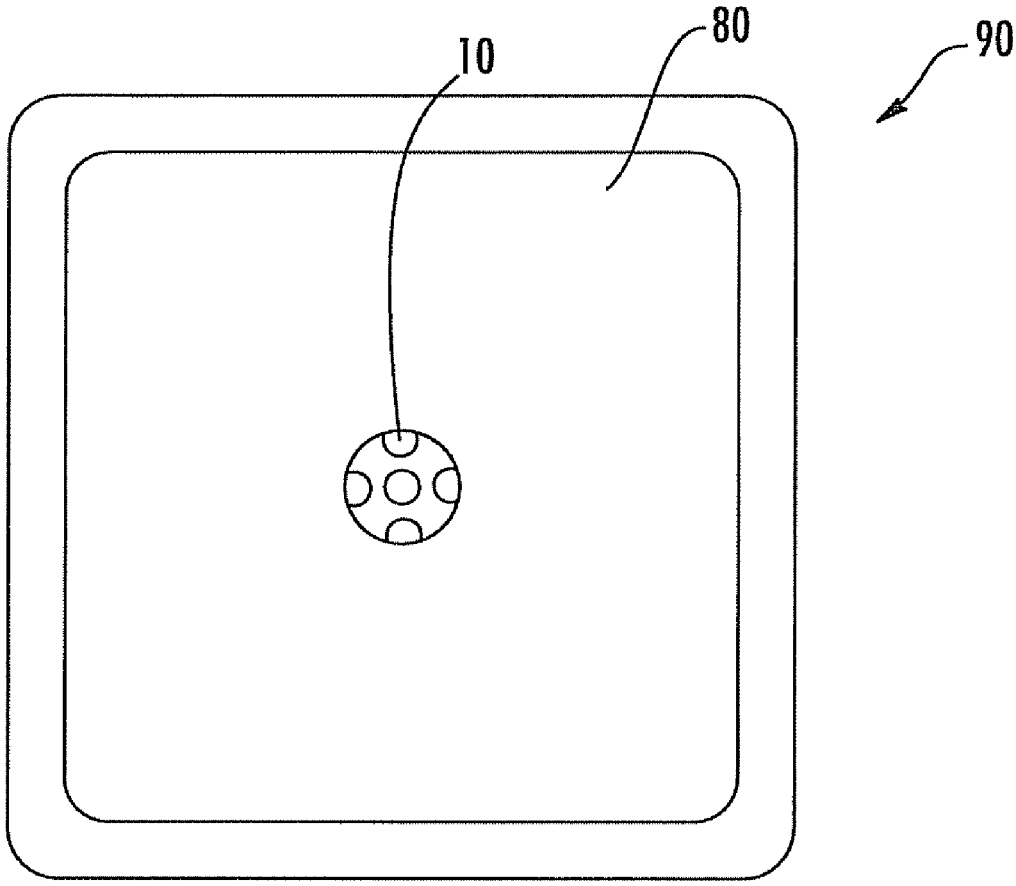
Figure 8E:
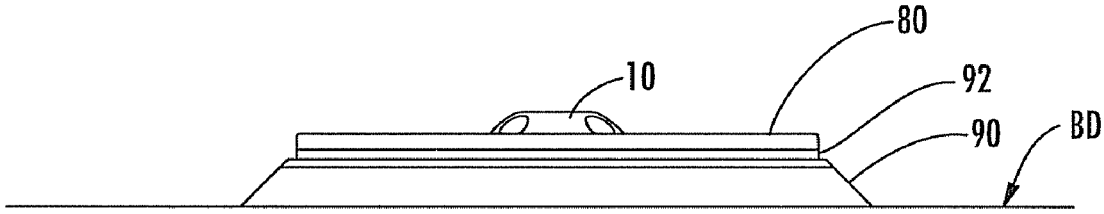

As shown in FIG. 8C, the cover 80 can be placed over the fastener 10 with the top member 14 passing through the aperture 86 in the body 88 of the cover 80 such that the cover 80 is around at least a portion of the bottom member 12. The top member 14 can then be rotated to a second position (as shown in FIG. 8D) where the second cross-sectional shape 18 of the top member 14 is out of alignment with first cross-sectional shape 14 of the bottom member 12 so that the top member 14 holds the cover 80 around the bottom member 12. As shown in FIG. 8E, the cover 80 rests above the window portion 92 of the hatch 90 that resides on a deck BD of the marine vessel in which the hatch 90 is installed.

As stated above, the cover may include multiple apertures for multiple fasteners. In such cases, the positions for multiple fasteners can be located on the outer surface 95 of the window portion 92 of the boat hatch 90 based on predetermined positions within the cover of multiple apertures corresponding to the number of fasteners to be attached.

Embodiments of the present disclosure shown in the drawings and described above are exemplary of numerous embodiments that can be made within the scope of the appending claims. It is contemplated that the configurations of fasteners and cover systems can comprise numerous configurations other than those specifically disclosed. The scope of a patent issuing from this disclosure will be defined by these appending claims.

What is claimed is:

1. A fastener attached to a boat hatch on a boat for use in fastening an item in place on the boat hatch, the fastener comprising:

a first member having a first cross-sectional shape;

a second member securable to the first member and rotatable relative to the first member once the second member is secured to the first member, the second member having a second cross-sectional shape;

a securement device attached to the boat hatch on the boat, the securement device fastening the first member to the boat hatch on the boat; and the second member being rotatable with respect to the first member to a first position such that the second cross-sectional shape of the second member is alignable with the first cross-sectional shape of the first member to permit placement of an item around at least a portion of the first member and the second member being rotatable to a second position where the second cross-sectional shape of the second member is out of alignment with the first cross-sectional shape of the first member and the second member holds the item around the first member to secure the item to the boat hatch on the boat, wherein the first member includes one or more protuberances and the second member has one or more matching recesses, each of the one or more protuberances residing in a corresponding recess of the one or more matching recesses when the second member is in the first position.

2. The fastener according to claim 1, wherein the second cross-sectional shape of the second member correspondingly matches the first cross-sectional shape of the first member.

3. The fastener according to claim 1, wherein the securement device is attached to an underside of the first member within at least one recess in the underside of the first member.

4. The fastener according to claim 1, further comprising an attachment member for securing the second member to the first member.

5. The fastener according to claim 4, wherein the attachment member comprises at least one of a rod, rivet, screw, or bolt and nut configuration.

6. The fastener according to claim 4, wherein the attachment member comprises a male and female connection.

7. The fastener according to claim 6, wherein a male portion of the male and female connection comprises two or more sections of a cylindrical body with a lip extending outward from each section at an end distal from an underside of the second member and a female portion of the male and female connection comprises an aperture defined in the first member with the aperture including at least one recess in which the lips of the sections of the male portion reside upon insertion of the sections of the cylindrical body of the male portion into the aperture of the female portion.

8. A fastener for use in fastening an item in place on an object, the fastener comprising:

a first member having a first cross-sectional shape;

a second member securable to the first member and rotatable relative to the first member once the second member is secured to the first member, the second member having a second cross-sectional shape;

a securement device for fastening the first member to an object; and the second member being rotatable with respect to the first member to a first position such that the second cross-sectional shape of the second member is alignable with the first cross-sectional shape of the first member to permit placement of an item around at least a portion of the first member and the second member being rotatable to a second position where the second cross-sectional shape of the second member is out of alignment with the first cross-sectional shape of the first member and the second member holds the item around the first member; and wherein the first cross-sectional shape of the first member includes one or more equally spaced flanges extending outward from a central segment of the first member and the second cross-sectional shape of the second member includes one or more equally spaced flanges extending outward from a central segment of the second member, each of the flanges of the first member and the second member are wider at a distal outer end of the respective flange than at an inner end of that flange that is proximal to the central segment of the respective member.

9. A cover system for covering a boat hatch on a boat, the system comprising:

at least one fastener secured to the boat hatch on the boat comprising:

a bottom member having a first cross-sectional shape;

a top member securable to the bottom member and rotatable relative to the bottom member once the top member is secured to the bottom member, the top member having a second cross-sectional shape; and a securement device attached to the boat hatch on the boat, the securement device fastening the bottom member to an outer surface of the boat hatch to be covered;

a cover having a body, the body of the cover configured to shield the outer surface of the boat hatch and the body of the cover defining at least one aperture therein for receipt of the first cross-sectional shape of the bottom member of the fastener; and the second cross-sectional shape of the top member of the fastener being alignable with the first cross-sectional shape of the bottom member of the fastener in a first position of the top member relative to the bottom member to permit placement of the cover around at least a portion of the bottom member over the outer surface of the boat hatch on the boat and the top member being rotatable to a second position where the second cross-sectional shape of the top member is out of alignment with the first cross-sectional shape of the bottom member and the top member holds the cover around the bottom member over the outer surface of the boat hatch on the boat, wherein the bottom member includes one or more protuberances and the top member has one or more matching recesses, each of the one or more protuberances residing in a corresponding recess of the one or more matching recesses when the top member is in the first position.

10. The system according to claim 9, wherein the first cross-sectional shape of the bottom member includes one or more flanges extending outward from a central segment of the first member and the second cross-sectional shape of the top member includes one or more flanges extending outward from a central segment of the second member, each of the flanges of the bottom member and the top member are wider at a distal outer end of the respective flange than at an inner end of that flange that is proximal to the central segment of the respective member.

11. The system according to claim 10, wherein the one or more flanges of the bottom member comprise four equally-spaced flanges and the one or more flanges of the top member comprise four equally-spaced flanges, the four equally-spaced flanges of the bottom member and the four equally-spaced flanges of the bottom member being alignable in the first position of the top member.

12. The system according to claim 11, wherein the aperture defined within the body of the cover has a shape that corresponds to the cross-sectional shape of the bottom member such that, when the cover is placed on the fastener, the first cross-sectional shape of the bottom member occupies the aperture and portions of the cover occupy spaces between the adjacent flanges.

13. The system according to claim 11, wherein each of the one or more protuberances reside in a space between adjacent flanges of the top member when the top member is in the second position.

14. The system according to claim 9, wherein the securement device comprises adhesive pads.

15. The system according to claim 9, further comprising an attachment member for securing the top member to the bottom member.

16. The system according to claim 15, wherein the attachment member comprises at least one of a rod, rivet, screw, or bolt and nut configuration.

17. The system according to claim 15, wherein the attachment member comprises a male and female connection.

18. The system according to claim 17, wherein a male portion of the male and female connection comprises two or more sections of a cylindrical body with a lip extending outward from each section at an end distal from an underside of the top member and a female portion of the male and female connection comprises an aperture defined in the bottom member with the aperture including at least one recess in which the lips of the sections of the male portion reside upon insertion of the sections of the cylindrical body of the male portion into the aperture of the female portion.

19. The system according to claim 9, wherein the body of the cover has an outer perimeter that has dimensions that are about the same as the dimension of a window portion of the boat hatch.

20. The system according to claim 9, wherein the body of the cover is buoyant.

* * * * *